US009078503B1

(12) United States Patent
Gilman

(10) Patent No.: US 9,078,503 B1
(45) Date of Patent: Jul. 14, 2015

(54) PURSE THEFT DETERRENT SYSTEM

(76) Inventor: Rosemarie Gilman, Weare, NH (US)

( * ) Notice: Subject to any disclaimer, the term of this patent is extended or adjusted under 35 U.S.C. 154(b) by 340 days.

(21) Appl. No.: 13/529,357

(22) Filed: Jun. 21, 2012

Related U.S. Application Data

(63) Continuation-in-part of application No. 12/765,656, filed on Apr. 22, 2010, now abandoned.

(51) Int. Cl.
*A45C 13/18* (2006.01)
*A45C 13/20* (2006.01)
*A45C 13/30* (2006.01)

(52) U.S. Cl.
CPC ..... *A45C 13/20* (2013.01); *A45C 13/18* (2013.01); *A45C 2013/306* (2013.01)

(58) Field of Classification Search
USPC ..... 150/106, 107, 118, 102, 101
See application file for complete search history.

(56) References Cited

U.S. PATENT DOCUMENTS

| | | | | | |
|---|---|---|---|---|---|
| 475,503 | A | | 5/1892 | Hock | |
| 596,395 | A | | 12/1897 | Corthell | |
| 1,166,612 | A | * | 1/1916 | Macaulay | 150/101 |
| 1,643,106 | A | | 9/1927 | Williams | |
| 2,413,465 | A | | 12/1946 | Ohlsen | |
| 2,783,926 | A | | 3/1957 | Wise | |
| 2,796,905 | A | | 6/1957 | Hebron | |
| 3,085,610 | A | * | 4/1963 | Vardan | 206/526 |
| 4,154,275 | A | | 5/1979 | Cauley | |
| 4,257,463 | A | | 3/1981 | Monaco | |
| 4,488,624 | A | * | 12/1984 | Myers | 190/120 |
| 4,804,122 | A | | 2/1989 | Knox | |
| 4,811,769 | A | | 3/1989 | Phares | |
| 5,042,649 | A | | 8/1991 | McNutt | |
| 5,251,743 | A | | 10/1993 | Pulido et al. | |
| 5,722,125 | A | | 3/1998 | Vasilopoulos | |
| 5,730,340 | A | * | 3/1998 | Bosic | 224/250 |
| 5,911,262 | A | | 6/1999 | Steinhart | |
| 5,934,123 | A | | 8/1999 | Eldredge | |
| 6,000,103 | A | | 12/1999 | Paice et al. | |
| 6,092,779 | A | | 7/2000 | Depew et al. | |
| 6,273,245 | B1 | | 8/2001 | Mickelson | |
| 6,283,183 | B1 | | 9/2001 | Cooper | |
| 6,298,993 | B1 | | 10/2001 | Kalozdi | |
| 6,422,278 | B1 | * | 7/2002 | Grogan | 150/105 |
| 6,425,167 | B1 | * | 7/2002 | Barbarite et al. | 24/298 |
| 6,491,074 | B1 | | 12/2002 | Roegner | |
| 6,513,661 | B1 | | 2/2003 | Mogil | |
| 7,020,935 | B2 | * | 4/2006 | Behn et al. | 24/298 |
| 7,334,712 | B2 | * | 2/2008 | Hassett et al. | 224/407 |
| 7,395,930 | B2 | | 7/2008 | Tauchen | |
| D596,395 | S | | 7/2009 | Cutler | |
| 2004/0045781 | A1 | * | 3/2004 | Scicluna et al. | 190/110 |
| 2005/0121121 | A1 | | 6/2005 | Wang | |
| 2005/0205178 | A1 | | 9/2005 | Wynona | |
| 2005/0263226 | A1 | | 12/2005 | Smithers | |
| 2010/0122560 | A1 | * | 5/2010 | Ricker et al. | 70/66 |
| 2011/0011504 | A1 | | 1/2011 | Steinbacher | |

* cited by examiner

*Primary Examiner* — Tri Mai

(57) ABSTRACT

A purse theft deterrent system for preventing undesired removal of items from a purse or the purse itself has a purse with a security rail located at least partially in a purse cavity. The system has an external independent anchoring member for use as a base of attachment for securing the purse with a flexible tether. A first tether end is located on a wallet, a pouch, or other item placed in a purse. A second tether end is located on the security rail for securing the wallet, the pouch, or other item placed in a purse to the purse via the security rail. A first tether end is located on the purse and a second tether end is attached on the anchoring member for securing the purse to the anchoring member.

13 Claims, 6 Drawing Sheets

PURSE THEFT DETERRENT SYSTEM

CROSS REFERENCE

This application claims priority to U.S. non-provisional application Ser. No. 12/765,656 filed Apr. 22, 2010 as a continuation-in-part, the specification of which is incorporated herein by reference in its entirety.

BACKGROUND OF THE INVENTION

Purse related theft, either of items inside the purse or theft of the purse itself, is unfortunately a common occurrence in society that could occur anywhere, for example, shopping malls, grocery stores, restaurants, public transportation systems or even in the streets. The present invention features a purse theft deterrent system for preventing undesired removal of items located in a purse as well as removal of the purse itself from a location.

SUMMARY

The present invention features a purse theft deterrent system for preventing undesired removal of items located in a purse as well as removal of the purse itself from a location. In some embodiments, the system comprises a purse. In some embodiments, the system comprises a security rail located at least partially in a purse cavity.

In some embodiments, the system comprises an external independent anchoring member for use as a base of attachment for securing the purse. In some embodiments, the system comprises a flexible tether. In some embodiments, a first tether end is located on a wallet, a pouch, or other item placed in a purse. In some embodiments, a second tether end is located on the security rail for securing the wallet, the pouch, or other item placed in a purse to the purse via the security rail. In some embodiments, a first tether end is located on the purse. In some embodiments, the second tether end is located on the anchoring member for securing the purse to the anchoring member.

In some embodiments, for operation the purse is located close to an anchoring member. In some embodiments, the purse is attached to the anchoring member via the tether. In some embodiments, for operation the wallet, the pouch, or other item placed in a purse is attached to the security rail via the tether.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
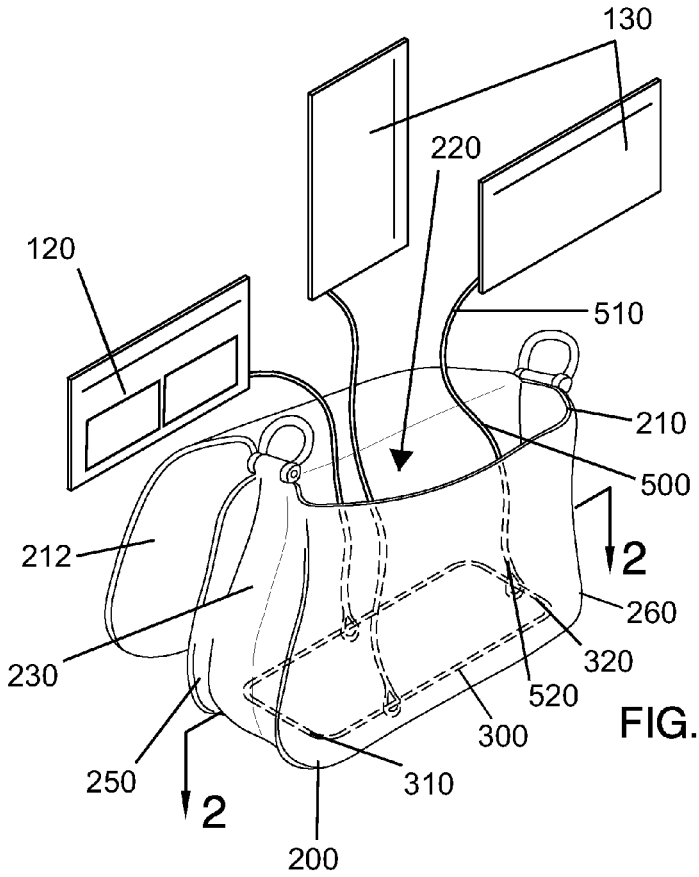
FIG. 1 is a perspective view of the purse and security rail of the present invention.
Figure 2:
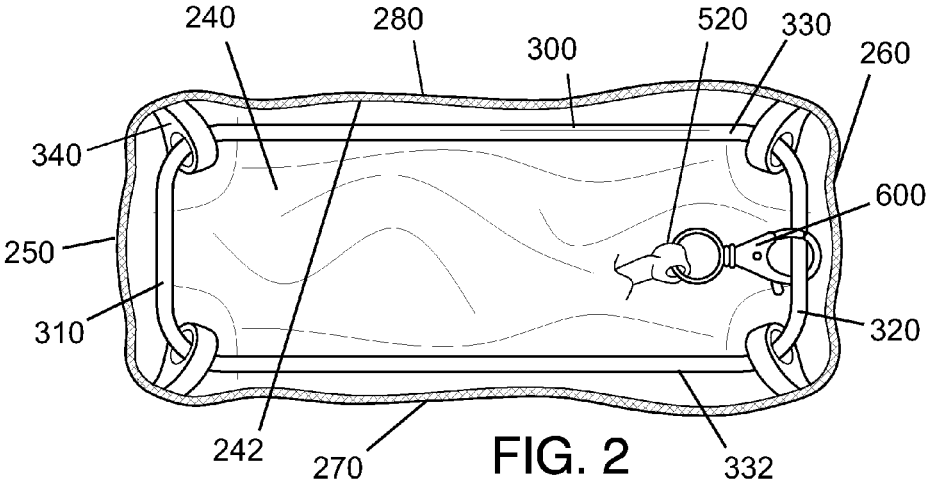
FIG. 2 is a top view of the security rail of the present invention.
Figure 3:
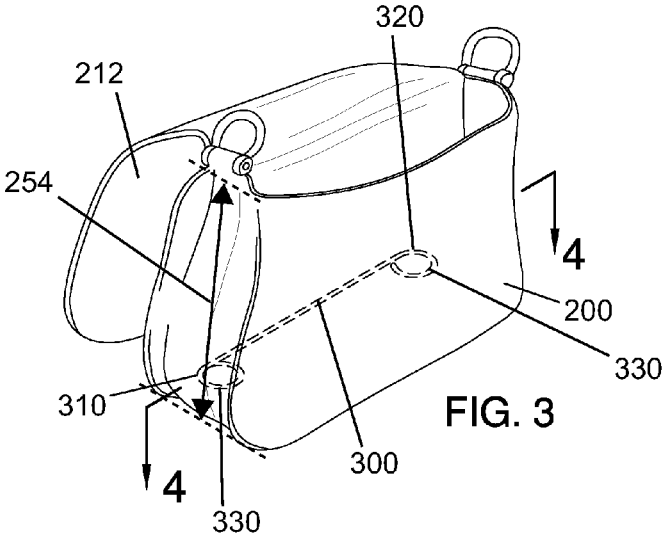
FIG. 3 is a perspective view of an alternate embodiment of the security rail the present invention.
Figure 4:
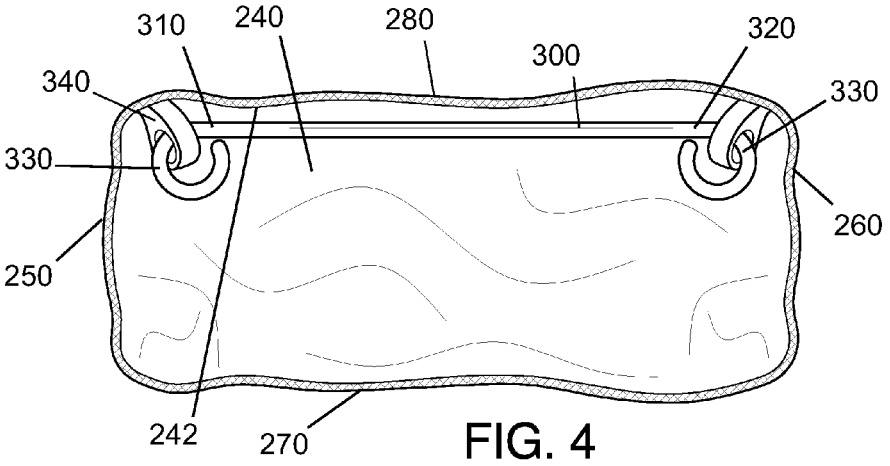
FIG. 4 is a top view of an alternate embodiment of the security rail of the present invention.
Figure 5:
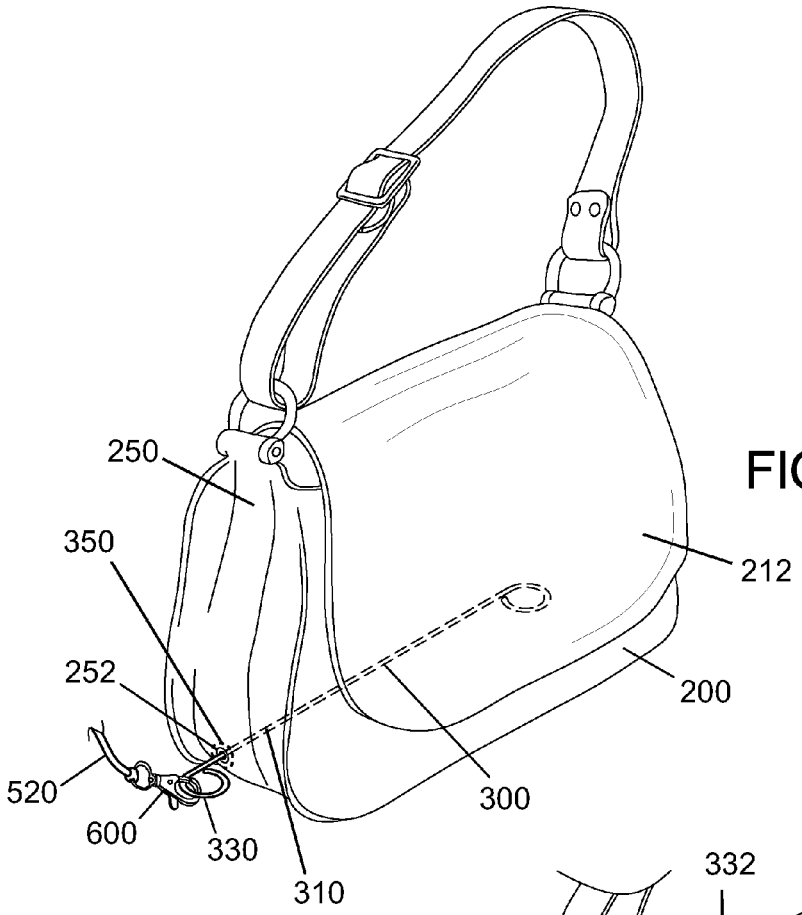
FIG. 5 is a perspective view of an alternate embodiment of the security rail of the present invention.
Figure 6:
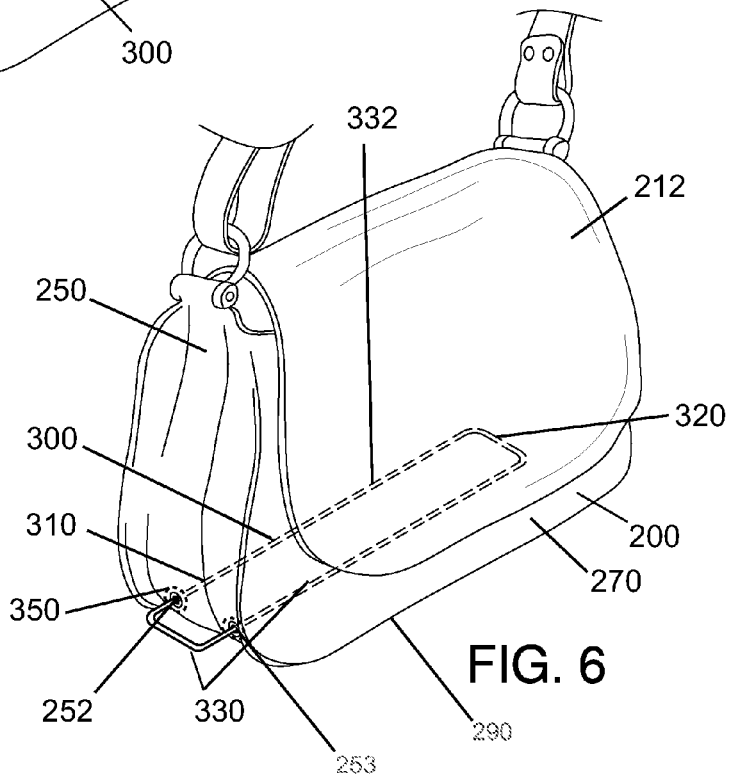
FIG. 6 is a perspective view of an alternate embodiment of the security rail of the present invention.
Figure 7:
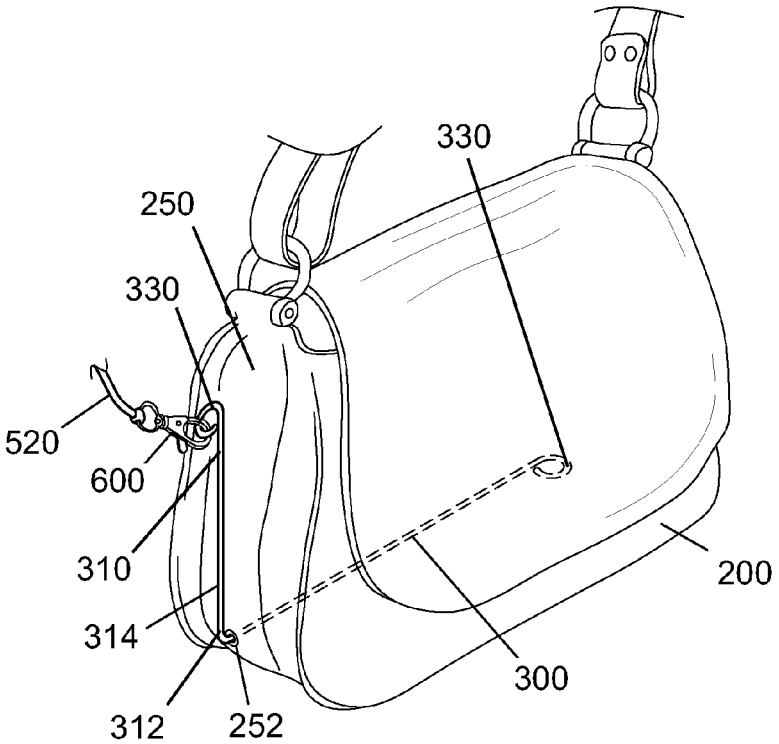
FIG. 7 is a perspective view of an alternate embodiment of the security rail of the present invention.
Figure 8:
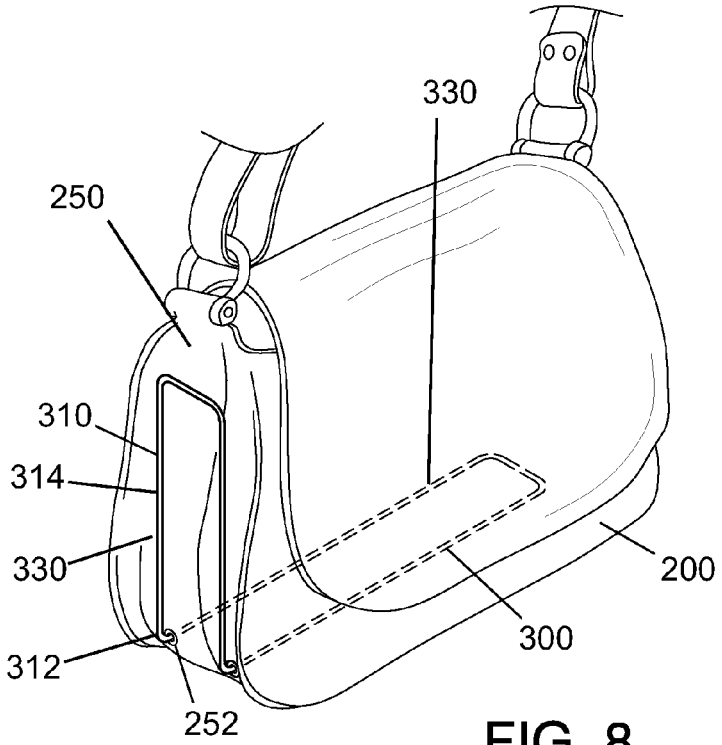
FIG. 8 is a perspective view of an alternate embodiment of the security rail of the present invention.
Figure 9:
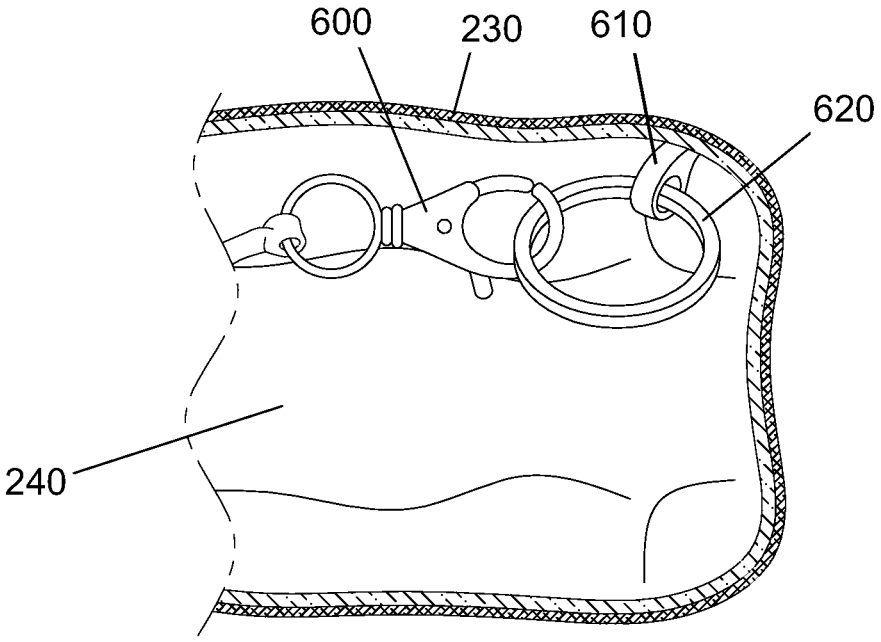
FIG. 9 is a detail view of the securing loop and ring of the present invention.
Figure 10:
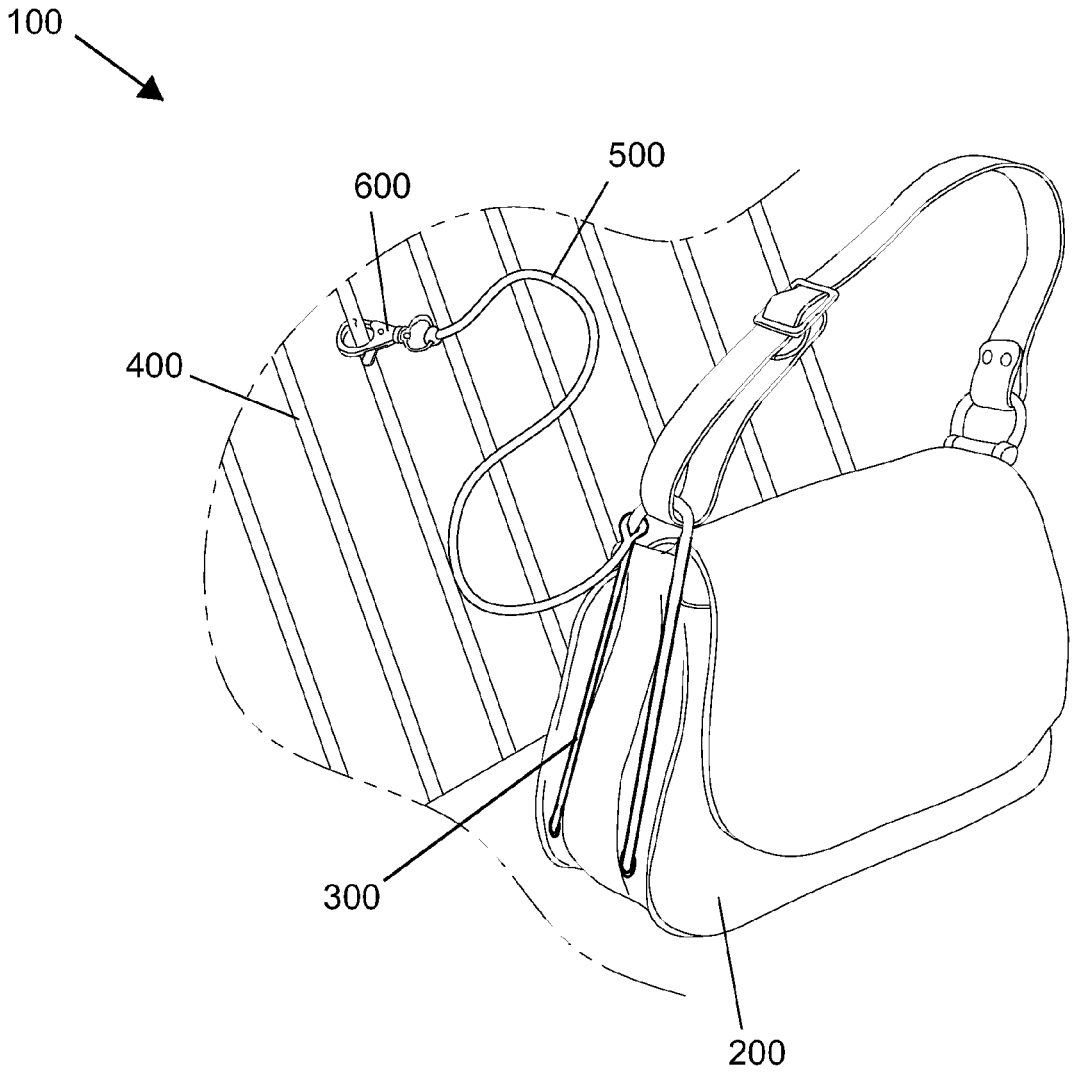
FIG. 10 is a perspective view of the present invention.

Following is a list of elements corresponding to a particular element referred to herein:

100 Purse theft deterrent system
120 Wallet
130 Pouch
200 Purse
210 Purse aperture
212 Closure means
220 Purse cavity
230 Purse external surface
240 Purse floor interior surface
242 Floor interior surface outer periphery
250 Purse first side
252 Purse first side aperture
254 Purse first side height
260 Purse second side
270 Purse first face
280 Purse second face
300 Security rail
310 Security rail first end
312 Bend
314 Side wall projection
320 Security rail second end
330 Security rail loop
332 Loop outer periphery
340 Strap
350 Security rail stop
400 External independent anchoring member
500 Flexible tether
510 First tether end
520 Second tether end
600 Clip
610 Securing loop
620 Ring Referring now to FIG. 1-10, the present invention features a purse theft deterrent system (100) for preventing undesired removal of items from a purse (200) including wallets (120) and pouches (130) as well as removal of the purse (200) itself from a location. In some embodiments, the system (100) comprises a purse (200) having a purse aperture (210) fluidly connected to a purse cavity (220), a purse external surface (230), a purse floor interior surface (240), a purse first side (250), a purse second side (260), a purse first face (270), and a purse second face (280). In some embodiments, the purse cavity (220) is located within the purse (200). In some embodiments, the purse aperture (210) is located at a top of the purse (200). In some embodiments, the purse floor interior surface (240) is located at a bottom of the purse cavity (220) opposite the purse aperture (210). In some embodiments, the purse first side (250) adjoins the purse first face (270) and the purse second face (280). In some embodiments, the purse second side (260) is opposite the purse first side (250) and adjoins the purse first face (270) and the purse second face (280). In some embodiments, the purse first face (270) adjoins the purse first side (250) and the purse second side (260). In some embodiments, the purse second face (280) is opposite the purse first face (270) and adjoins the purse first side (250) and the purse second side (260).

In some embodiments, the system (100) comprises a security rail (300) having a security rail first end (310), a security rail second end (320), and a security rail loop (330). In some embodiments, the security rail (300) is located at least partially in the purse cavity (220) close to the purse floor interior surface (240), In some embodiments, the security rail (300) is securely and permanently connected to the purse (200) close to the purse floor interior surface (240) via a strap (340). In some embodiments, the security rail (300) traverses the purse floor interior surface (240) from the purse first side (250) to the purse second side (260). In some embodiments, the security rail (300) is at least partially exposed. In some embodiments, the security rail (300) is constructed from a material comprising a high tensile strength.

In some embodiments, the system (100) comprises an external independent anchoring member (400) for use as a base of attachment for securing the purse (200), for example a shopping cart, a chair, a bench, a table, a desk, or other stationary object. In some embodiments, the system (100) comprises a flexible tether (500) having a first tether end (510) and a second tether end (520). In some embodiments, a first first tether end (510) is located in an attachable, detachable and reattachable manner on a wallet (120), a pouch (130) or other purse contents. In some embodiments, a first second tether end (520) is located in an attachable, detachable and reattachable manner on the security rail (300) for securing the wallet (120), the pouch (130) or other purse contents to the purse (200) via the security rail (300). In some embodiments, a second first tether end (510) is located in an attachable, detachable and reattachable manner on the purse (200). In some embodiments, the second second tether end (520) is located in an attachable, detachable and reattachable manner on the external independent anchoring member (400) for securing the purse (200) to the external independent anchoring member (400).

In some embodiments, for operation the purse (200) is located close to an external independent anchoring member (400). In some embodiments, the purse (200) is attached to the external independent anchoring member (400) via the flexible tether (500). In some embodiments, for operation the wallet (120), the pouch (130), or other purse contents, is attached to the security rail (300) via the flexible tether (500).

In some embodiments, the security rail (300) is constructed from a metal. In some embodiments, a cross-section of the security rail (300) in a transverse plane comprises a shape of a circle. In some embodiments, a cross-section of the security rail (300) in a transverse plane comprises a shape of a polygon. In some embodiments, the security rail (300) is coated or plated with a corrosion resistant material.

In some embodiments, the security rail loop (330) of the security rail (300) comprises a loop outer periphery (332). In some embodiments, the loop outer periphery (332) traverses a purse floor interior surface outer periphery (242). In some embodiments, the security rail (300) comprises the shape of a fully enclosed loop with no terminating ends. In some embodiments, the security rail loop (330) comprises the security rail first end (310) located on a side of the security rail loop (330) and the security rail second end (320) located on an opposing side of the security rail loop (330).

In some embodiments, the security rail loop (330) comprises a general shape of a rectangle. In some embodiments, the security rail loop (330) comprises a general shape of an ellipse.

In some embodiments, the security rail first end (310) projects through a purse first side aperture (252) located in the purse first side (250) out and away from the purse external surface (230) on the purse first side (250). In some embodiments, the projecting security rail first end (310) comprises an external security rail loop (330). In some embodiments, the external security rail loop is formed by the security rail (300) intersecting with the purse first side (250). In some embodiments, an internal security rail loop is formed by the security rail intersecting with the purse first side (250). In some embodiments, the security rail (300) comprises a security rail stop (350) located on (for example, welded to) the security rail (300) inside the purse cavity (220) close to the security rail first end (310) for securing the security rail (300) with respect to the purse first side (250). In some embodiments, the security rail stop (350) is located against an interior surface of the purse first side (250).

In some embodiments, the security rail first end (310) comprises a bend (312) (for example about 90 degrees) and a security rail side wall projection (314) traversing a purse first side height (254). In some embodiments, the side wall projection (314) traverses the purse first side height (254) from about the purse first side aperture (252) to about the purse aperture (210). In some embodiments, the side wall projection (314) is attached to the purse first side (250) for stability.

In some embodiments, the purse aperture (210) comprises a closure means (212) for securing the purse aperture (210), wherein the closure means (212) is secured via a clip (600). In some embodiments, the closure means (212) is a flap. In some embodiments, the closure means (212) is a snap or other attaching mechanism.

In some embodiments, a clip (600) is located on a purse first side (250) on the purse external surface (230) for attaching to the external independent anchoring member (400). In some embodiments, a clip (600) is located on a purse second side (260) on the purse external surface (230) for attaching to the external independent anchoring member (400).

In some embodiments, a securing loop (610) is sewn into or onto the purse (200) for attaching a clip (600). In some embodiments, a securing loop (610) is sewn into or onto the purse (200) for attaching a ring (620). In some embodiments, a ring (620) is located on the purse (200), the pouch (130) or the wallet (120) for enabling attachment of a clip (600).

In some embodiments, the security rail (300) is securely and permanently connected to the purse (200) close to the purse floor interior surface (240) via a plurality of straps (340).

In some embodiments, the security rail (300) comprises the security rail loop (330) located on the security rail first end (310) or the security rail second end (320). In some embodiments, the security rail (300) comprises a first security rail loop (330) located on the security rail first end (310) and a second security rail loop (330) located on the security rail second end (320).

In some embodiments, the first tether end (510) or the second tether end (520) comprises a clip (600) for attachable and removable connection to an object. In some embodiments, the first tether end (510) and the second tether end (520) each comprise a clip (600) for attachable and removable connection to an object.

As used herein, the term "about" refers to plus or minus 10% of the referenced number. For example, an embodiment wherein the security rail is about 10 inches in length includes a security rail that is between 9 and 11 inches in length.

The disclosures of the following U.S. Patents are incorporated in their entirety by reference herein: U.S. Patent Publication 2011/0011504 A1; U.S. Patent Publication 2005/

0205178; U.S. Patent Publication 2005/0121121; U.S. Pat. No. 7,395,930; U.S. Pat. No. 6,283,183; U.S. Pat. No. 3,346,155; U.S. Pat. No. 2,796,905; U.S. Pat. No. 1,643,106.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A purse theft deterrent system (100) for preventing undesired removal of items from a purse (200) including wallets (120) and pouches (130) as well as removal of the purse (200) itself from a location, wherein said system (100) comprises:

(a) a purse (200) having a purse aperture (210) fluidly connected to a purse cavity (220), a purse external surface (230), a purse floor interior surface (240), a purse first side (250), a purse second side (260), a purse first face (270), and a purse second face (280), wherein the purse cavity (220) is disposed within the purse (200), wherein the purse aperture (210) is disposed at a top of the purse (200), wherein the purse floor interior surface (240) is disposed at a bottom of the purse cavity (220) opposite the purse aperture (210), wherein the purse first side (250) adjoins the purse first face (270) and the purse second face (280), wherein the purse second side (260) is opposite the purse first side (250) and adjoins the purse first face (270) and the purse second face (280), wherein the purse first face (270) adjoins the purse first side (250) and the purse second side (260), wherein the purse second face (280) is opposite the purse first face (270) and adjoins the purse first side (250) and the purse second side (260);

(b) a security rail (300) having a security rail first end (310), a security rail second end (320), and a security rail loop (330), wherein the security rail (300) is at least partially exposed, wherein the security rail (300) is disposed at least partially in the purse cavity (220), wherein the security rail first end (310) projects through a first purse first side aperture (252), disposed in the purse first side (250), out and away from the purse external surface (230) on the purse first side (250), wherein the projecting security rail first end (310) comprises the security rail loop (330), wherein the projecting security rail first end (310) forming the security rail loop (330) also projects through a second purse first side aperture (253) disposed in the purse first side (250) inwardly into the purse cavity (220) and towards the purse second face (280), wherein the first purse first side aperture (252) and the second purse first side aperture (253) are disposed in the purse first side (250) proximal to a purse base (290) wherein the purse base (290) is disposed opposite the purse aperture (210), wherein the entire security rail (300) is immediately proximal to the purse floor interior surface (240), wherein the security rail (300) is securely and permanently connected to the purse (200) proximal to the purse floor interior surface (240) via a strap (340), wherein the security rail (300) traverses the purse floor interior surface (240) from the purse first side (250) to the purse second side (260), wherein the security rail (300) comprises a security rail stop (350) affixedly disposed on the security rail (300) inside the purse cavity (220) proximal to the security rail first end (310) for securing the security rail (300) with respect to the purse first side (250), wherein the security rail stop (350) is disposed against an interior surface of the purse first side (250), wherein the security rail (300) is constructed from a material comprising a high tensile strength;

(c) an external independent anchoring member (400) for use as a base of attachment for securing the purse (200); and (d) a flexible tether (500) having a first tether end (510) and a second tether end (520), wherein a first first tether end (510) is attachably and removably disposed on a wallet (120), a pouch (130) or other purse contents, wherein a first second tether end (520) is attachably and removably disposed on the security rail (300) for securing the wallet (120), the pouch (130) or other purse contents to the purse (200) via the security rail (300), wherein a second first tether end (510) is attachably and removably disposed on the purse (200), wherein the second second tether end (520) is attachably and removably disposed on the external independent anchoring member (400) for securing the purse (200) to the external independent anchoring member (400);

wherein for operation the purse (200) is disposed proximal to the external independent anchoring member (400), wherein the purse (200) is attached to the external independent anchoring member (400) via the flexible tether (500), wherein for operation the wallet (120), the pouch (130), or other purse contents, is attached to the security rail (300) via the flexible tether (500).

2. The system (100) of claim 1, wherein the security rail (300) is constructed from a metal.

3. The system (100) of claim 1, wherein the security rail loop (330) of the security rail (300) comprises a loop outer periphery (332), wherein the loop outer periphery (332) traverses a purse floor interior surface outer periphery (242), wherein the security rail (300) comprises a shape of a fully enclosed loop with no terminating ends, wherein the security rail loop (330) comprises the security rail first end (310) disposed on a side of the security rail loop (330) and the security rail second end (320) disposed on an opposing side of the security rail loop (330).

4. The system (100) of claim 3, wherein the security rail loop (330) comprises a general shape of a rectangle.

5. The system (100) of claim 3, wherein the security rail loop (330) comprises a general shape of an ellipse.

6. The system (100) of claim 1 wherein the purse aperture (210) comprises a closure means (212) for securing the purse aperture (210).

7. The system (100) of claim 1, wherein a clip (600) is disposed on the purse first side (250) on the purse external surface (230) for attaching to the external independent anchoring member (400).

8. The system (100) of claim 1, wherein a clip (600) is disposed on the purse second side (260) on the purse external surface (230) for attaching to the external independent anchoring member (400).

9. The system (100) of claim 1, wherein a securing loop (610) is sewn into or onto the purse (200) for attaching a clip (600).

10. The system (100) of claim 1, wherein the security rail (300) is securely and permanently connected to the purse (200) proximal to the purse floor interior surface (240) via a plurality of straps (340).

11. The system (100) of claim 1, wherein the first tether end (510) or the second tether end (520) comprises a clip (600) for attachable and removable connection to an object.

12. The system (100) of claim 1, wherein the first tether end (510) and the second tether end (520) each comprise a clip (600) for attachable and removable connection to an object.

13. A purse theft deterrent system (100) for preventing undesired removal of items from a purse (200) including wallets (120) and pouches (130) as well as removal of the purse (200) itself from a location, wherein said system (100) consists of:

(*a*) a purse (200) consisting of a purse aperture (210) fluidly connected to a purse cavity (220), a purse external surface (230), a purse floor interior surface (240), a purse first side (250), a purse second side (260), a purse first face (270), and a purse second face (280), wherein the purse cavity (220) is disposed within the purse (200), wherein the purse aperture (210) is disposed at a top of the purse (200), wherein the purse floor interior surface (240) is disposed at a bottom of the purse cavity (220) opposite the purse aperture (210), wherein the purse first side (250) adjoins the purse first face (270) and the purse second face (280), wherein the purse second side (260) is opposite the purse first side (250) and adjoins the purse first face (270) and the purse second face (280), wherein the purse first face (270) adjoins the purse first side (250) and the purse second side (260), wherein the purse second face (280) is opposite the purse first face (270) and adjoins the purse first side (250) and the purse second side (260);

(b) a security rail (300) consisting of a security rail first end (310), a security rail second end (320), and a security rail loop (330), wherein the security rail (300) is at least partially exposed, wherein the security rail (300) is disposed at least partially in the purse cavity (220), wherein the security rail first end (310) projects through a first purse first side aperture (252), disposed in the purse first side (250), out and away from the purse external surface (230) on the purse first side (250), wherein the projecting security rail first end (310) consists of the security rail loop (330), wherein the projecting security rail first end (310) forming the security rail loop (330) also projects through a second purse first side aperture (253) disposed in the purse first side (250) inwardly into the purse cavity (220) and towards the purse second face (280), wherein the first purse first side aperture (252) and the second purse first side aperture (253) are disposed in the purse first side (250) proximal to a purse base (290) wherein the purse base (290) is disposed opposite the purse aperture (210), wherein the entire security rail (300) is immediately proximal to the purse floor interior surface (240), wherein the security rail (300) is securely and permanently connected to the purse (200) proximal to the purse floor interior surface (240) via a strap (340), wherein the security rail (300) traverses the purse floor interior surface (240) from the purse first side (250) to the purse second side (260), wherein the security rail (300) consists of a security rail stop (350) affixedly disposed on the security rail (300) inside the purse cavity (220) proximal to the security rail first end (310) for securing the security rail (300) with respect to the purse first side (250), wherein the security rail stop (350) is disposed against an interior surface of the purse first side (250), wherein the security rail (300) is constructed from a material consisting of a high tensile strength;

(c) an external independent anchoring member (400) for use as a base of attachment for securing the purse (200); and (d) a flexible tether (500) consisting of a first tether end (510) and a second tether end (520), wherein a first first tether end (510) is attachably and removably disposed on a wallet (120), a pouch (130) or other purse contents, wherein a first second tether end (520) is attachably and removably disposed on the security rail (300) for securing the wallet (120), the pouch (130) or other purse contents to the purse (200) via the security rail (300), wherein a second first tether end (510) is attachably and removably disposed on the purse (200), wherein the second tether end (520) is attachably and removably disposed on the external independent anchoring member (400) for securing the purse (200) to the external independent anchoring member (400);

wherein for operation the purse (200) is disposed proximal to the external independent anchoring member (400), wherein the purse (200) is attached to the external independent anchoring member (400) via the flexible tether (500), wherein for operation the wallet (120), the pouch (130), or other purse contents, is attached to the security rail (300) via the flexible tether (500).

* * * * *